US008801361B2

(12) United States Patent
Hawkins

(10) Patent No.: US 8,801,361 B2
(45) Date of Patent: Aug. 12, 2014

(54) TURBOMACHINE WHEEL POSITION CONTROL

(75) Inventor: Lawrence A. Hawkins, Redondo Beach, CA (US)

(73) Assignee: Calnetix Technologies, LLC, Yorba Linda, CA (US)

( * ) Notice: Subject to any disclaimer, the term of this patent is extended or adjusted under 35 U.S.C. 154(b) by 546 days.

(21) Appl. No.: 13/206,666

(22) Filed: Aug. 10, 2011

(65) Prior Publication Data

US 2013/0039740 A1 Feb. 14, 2013

(51) Int. Cl.
*F04D 5/00* (2006.01)

(52) U.S. Cl.
USPC ..... 415/1; 415/10; 415/14; 415/15; 415/118; 415/173.1; 415/173.2; 415/174.1; 415/229; 416/1; 416/3; 416/35; 416/61; 416/174

(58) Field of Classification Search
USPC ..... 415/1, 10, 14, 15, 118, 173.1, 173.2, 415/174.1, 229; 416/1, 3, 35, 61, 174
See application file for complete search history.

(56) References Cited

U.S. PATENT DOCUMENTS 4,523,896 A * 6/1985 Lhenry et al. ..... 417/244
5,263,816 A * 11/1993 Weimer et al. ..... 415/131
5,445,494 A * 8/1995 Hanson ..... 415/107
5,924,847 A * 7/1999 Scaringe et al. ..... 417/42
6,273,671 B1 * 8/2001 Ress, Jr. ..... 415/1
6,727,617 B2 4/2004 McMullen et al.
7,053,511 B2 * 5/2006 Taniguchi et al. ..... 310/90.5
8,384,232 B2 * 2/2013 Myers et al. ..... 290/52

OTHER PUBLICATIONS

Maghon, Hans, et al., "*50-Hz Heavy Duty Gas Turbines—Experience and Evolution*," Siemens Power Generation (PG), 2005 (10 pages).
Scott R. Myers et al., "Generating Energy from Fluid Expansion" U.S. Appl. No. 12/839,257, filed Jul. 19, 2010 (40 pages).
U.S. Appl. No. 12/475,052, filed May 29, 2009, Filatov.
U.S. Appl. No. 12/790,616, filed May 28, 2010, Myers, et al.

* cited by examiner

*Primary Examiner* — Igor Kershteyn
(74) *Attorney, Agent, or Firm* — Fish & Richardson P.C.

(57) ABSTRACT

A machine includes a rotor supported to rotate about a rotational axis and an actuator arranged to act on the rotor and control a position of the rotor about the rotational axis. A bladed turbomachine wheel is coupled to the rotor and has blade tips that pass closely to an adjacent, non-rotating surface. A sensor is adjacent to the turbomachine wheel and arranged to sense the blade tips and output a position signal representative of the position of blade tips relative to the sensor. A controller is coupled to the sensor and the actuator and is adapted to receive the position signal from the sensor and generate and send a control signal to the actuator to control the position of the rotor based on the position signal from the sensor.

20 Claims, 2 Drawing Sheets

TURBOMACHINE WHEEL POSITION CONTROL

BACKGROUND

This document relates to position control of rotating turbomachine wheels.

In a rotating machine with magnetic bearings, the magnetic bearings can be controlled to control the position of the rotating assembly. In the instance of a rotating assembly that includes a turbomachine wheel, the magnetic bearings can be controlled to control the position of the turbomachine wheel relative to an adjacent, stationary turbomachine wheel shroud. The position of the turbomachine wheel relative to the shroud is affected by movement of the rotating assembly as a whole due to dynamic effects, movement of the rotating assembly as a whole and deflection of the turbomachine wheel due to pressure changes of the fluid flowing through the turbomachine wheel, and expansion/contraction of the turbomachine wheel and remaining rotating and stationary assemblies due to thermal effects. Rotating machines typically include position sensors on the rotating element, but not measuring the position of the turbomachine wheel directly. Therefore, positional changes of the turbomachine wheel that are not carried through to the location of the sensor are not accounted for.

SUMMARY

A sensor proximate the turbomachine wheel measures the blade tips of the turbomachine wheel to facilitate positional control of the turbomachine wheel, and particularly control to maintain the position of the blade tips relative to an adjacent non-rotating surface such as a shroud to the turbomachine wheel.

In one aspect, a machine includes a rotor supported to rotate about a rotational axis and an actuator arranged to act on the rotor and control a position of the rotor about the rotational axis. A bladed turbomachine wheel is coupled to the rotor and has blade tips that pass closely to an adjacent, non-rotating surface. A sensor is adjacent to the turbomachine wheel and arranged to sense the blade tips and output a position signal representative of the position of blade tips relative to the sensor. A controller is coupled to the sensor and the actuator and is adapted to receive the position signal from the sensor and generate and send a control signal to the actuator to control the position of the rotor based on the position signal from the sensor.

In one aspect, a method includes sensing passage of blade tips of a rotating bladed turbomachine wheel by a sensor and outputting a signal representative of the position of the blade tips relative to the sensor. An actuator control signal is generated to control a position of the bladed turbomachine wheel based on the signal.

In one aspect, a turbomachine includes a magnetic bearing system having magnetic actuators that support a rotor to rotate about a rotational axis. A bladed turbomachine wheel is coupled to the rotor and has blade tips that pass closely to an adjacent shroud surface. An axial position sensor is arranged to sense the rotor and output an axial position signal representative of the axial position of the rotor. A sensor is affixed at the shroud surface and arranged to sense the blade tips and output a position signal representative of the axial position of blade tips relative to the shroud surface. A controller is coupled to the axial position sensor, the sensor affixed at the shroud surface, and the magnetic actuator. The controller is adapted to control the axial position of the rotor based on the output from the axial position sensor and the sensor affixed at the shroud surface.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
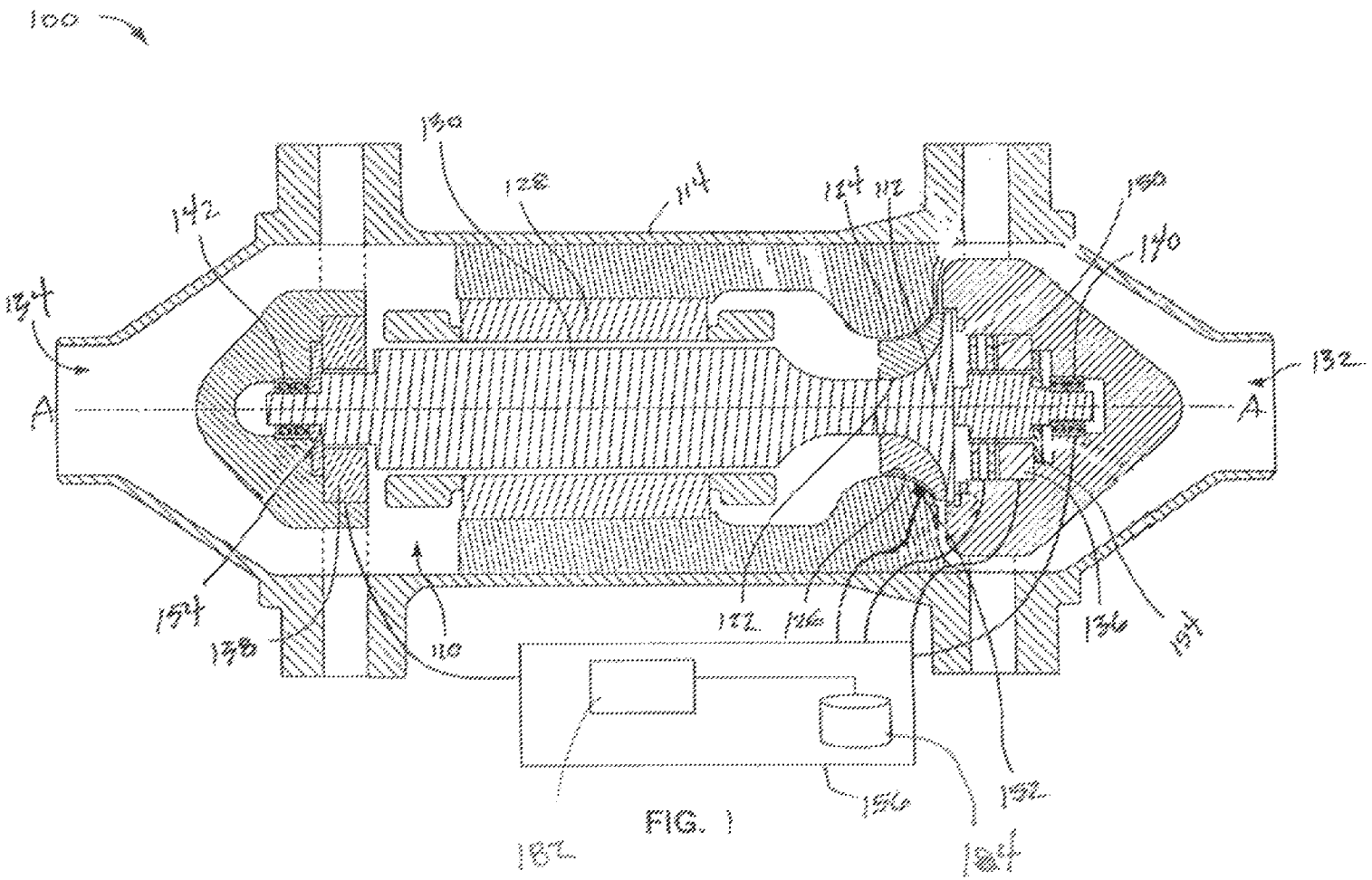
FIG. 1 is a schematic side cross-sectional view of an example machine in accordance with the concepts described herein.

FIG. 1 shows an example machine 100 constructed in accordance with the concepts described herein. The example machine 100 includes a motor and/or generator (hereinafter motor/generator 110) coupled to a turbomachine wheel 112 encased in a sealed housing 114. The example machine 100 can be a number of different types of machines. In one example, the machine 100 is a generator, where the turbomachine wheel 112 is a gas and/or liquid turbine through which a working fluid can be passed and/or expanded to drive the motor/generator 110 to generate electricity. In another example, the machine 100 is a pump or compressor, where the turbomachine wheel 112 is an impeller (e.g., pump or compressor impeller) that is rotated by the motor/generator 110 to pump or compress fluids. In yet another example, the machine 100 operates both as a generator and as a pump or compressor, where the turbomachine wheel 112 is an impeller/turbine, through which a working fluid can be passed and/or expanded to drive the motor/generator 110 to generate electricity and that, when rotated by the motor/generator 110, can pump or compress fluids. In some instances, the machine 100 can have multiple turbomachine wheels 112. For example, the machine 100 can be a two stage compressor with compressor turbomachine wheels 112 at opposing ends of the machine. In yet another example, the machine 100 can be a turboexpander a compressor turbomachine wheel 112 on one end and a turbine turbomachine wheel 112 on the other end, and in certain instances, being provided with or without a generator or motor. Still other example configurations of machine 100 exist.

The turbomachine wheel 112 can, likewise, take a number of different forms. For example, the turbomachine wheel 112 can be single or multi-stage, i.e., having two or more separate impeller/turbine stages on the same wheel. The turbomachine wheel 112 can be an axial wheel, a radially wheel, a centrifugal wheel or another type of wheel.

The turbomachine wheel 112 is coupled to rotate with the rotor 130 of the motor/generator 110. The rotor 130 is carried to rotate about a rotational axis A-A in the stator 128 of the motor/generator 110. In certain instances, the turbomachine wheel 112 is directly affixed to the rotor 130, or to an intermediate common shaft, for example, by fasteners, a rigid drive shaft, welding, or in another manner. If directly affixed, the turbomachine wheel 112 and rotor 130 can be coupled without a gear train and rotate at the same speed. Such an example machine 100 is what is referred to as a "high speed" machine. While the motor/generator 110 can take a number of different forms, in certain instances, the motor/generator 110 is a synchronous, permanent magnet rotor, multiphase AC motor/generator.

The turbomachine wheel 112 is a bladed wheel and includes a plurality of blades 122 extending radially outwardly from a hub. In the case of a turbine, the blades are configured to react with fluid flowing through the turbomachine wheel 112 to cause the wheel to rotate. In the case of a pump or compressor, the blades 122 are configured to act on the fluid to pump or compress the fluid. Each of the blades 122 has an exposed blade tip 124 extending between the inlet and the outlet of the wheel 112. As the wheel 112 rotates about a rotational axis A-A, the blade tips 124 pass closely to an adjacent shroud surface 126 in the interior of the housing 114 and substantially seal with the shroud surface 126 so that fluid is forced to flow between the wheel's inlet and outlet. The clearance between the blade tips 124 is a specified distance, or range of distances, selected to achieve the substantial seal. In certain instances, the specified distance can be different under different conditions. For example, the specified distance can be relatively large during start-up to allow the turbomachine wheel 112 to begin rotating in response without requiring constant correction to its position as the temperature, pressure and rotation speed come up to operating conditions. When the machine 100 has reached steady state operating conditions, the specified distance may be smaller to improve the seal between the turbomachine wheel 112 and the shroud surface 126.

In the example machine 100 of FIG. 1, fluid flows between the ends 132, 134 of the housing 114 through or around the motor/generator 110 and through the turbomachine wheel 112. Bearings 136, 138 are arranged to support the rotor 130 and turbomachine wheel 112 to rotate in the stator 128. One or more of the bearings 136, 138 can include ball bearings, needle bearings, non-contact magnetic bearings, foil bearings, journal bearings, and/or others. Both bearings 136, 138 need not be the same types of bearings. In certain instances, the bearings 136, 138 are actuators of a magnetic bearing system. In certain instances, the bearing 136 nearest the wheel 112 is a combination radial and thrust actuator that can act on the rotor 130 applying force in radial and axial directions without contacting the rotor 130. Bearing 138 is a radial actuator that can act on the rotor 130 applying force radially without contacting the rotor 130. The combination radial and thrust actuator can be modulated to control the axial position of the rotor 130. Other configurations could be utilized. For example, mechanical or fluid type bearings (i.e., not magnetic actuators) can be used in combination with an actuator, such as a linear actuator or rotary actuator and gear or linkage acting on the rotor 130, to control the position of the rotor 130. In the embodiments in which the bearings 136, 138 are magnetic bearings, the example machine 100 may include one or more backup bearings 140, 142, for example, for use at start-up and shut-down or in the event of a power outage that affects the operation of the magnetic bearings 136, 138.

The example machine 100 includes an axial position sensor 150 coupled to the rotor 130 to measure and output a signal representative of the axial position of the rotating assembly, i.e., the rotor 130 and turbomachine wheel 112. The axial position sensor 150 is positioned at a location proximate the rotating assembly. The example machine 100 additionally includes a sensor 152 adjacent the turbomachine wheel 112 (shown here, embedded in the shroud surface 126, but other suitable locations exist) arranged to sense the blade tips 124 and output a signal representative of the position of the blade tips 124 to the sensor 152. The sensor 152 can be positioned flush with the shroud surface 126, such that the distance between the blade tips 124 and the sensor 152, measured by the sensor 152, is equal to the distance between the blade tips 124 and the shroud surface 126 itself. Alternately, the sensor 152 can be at some other fixed location relative to the shroud surface 126 and the distance measured by the sensor adjusted (e.g., by adding or subtracting the distance between the shroud surface 126 and sensor 152) to represent the position of the blade tips 124 to the shroud surface 126. The sensor 150 can be oriented axially to measure an axial distance from the blade tips 124, radially to measure a radial distance from the blade tips 124 or in another orientation (e.g., between axial and radial) to measure a distance that includes both radial and axial components. The machine 100 also includes radial position sensors 154 arrayed around the rotor 130, and that measure and output a signal representative of the radial position of the rotor 130.

The axial position sensors 150, 154 provide position information for primary magnetic actuator control (e.g., control of combination actuator 136 and radial actuator 138), including control to compensate for dynamic, fluctuations in the position of the rotor 130 and turbomachine wheel 112. One example of a position sensor that can be used as axial position sensor 150 is described in U.S. patent application Ser. No. 12/475,052, entitled MEASURING THE POSITION OF AN OBJECT, and filed May 29, 2009. The axial position sensor 150 can alternately be of another configuration. For example, the axial position sensor of the above-referenced publication measures the axial position from a radial face of the rotor by detecting an axial discontinuity (e.g., an edge) in magnetic properties. In other instances, the axial sensor can detects axial position from an axial face. An example of a sensor that detects axial position from an axial face is an eddy-current proximity probe. Some other example sensors include a reluctance sensor or a capacitive sensor. Still other examples exist.

The sensor 152 provides a position or proximity information for small static or low frequency fluctuations in the position of the rotor 130 and particularly the turbomachine wheel 112 and its position relative to the shroud surface 126. Such small fluctuations or displacements may be caused by thermal effects (e.g., during warm-up or due to speed changes of the turbomachine wheel), deflection of the turbomachine wheel, or pressure gradients from the flow of fluid through the machine 100. Additionally, its placement to read from the blade tips 124 of the turbomachine wheel 112 enables the sensor 152 to account for thermal effects and deflection of the turbomachine wheel 112 in the proximity of the shroud surface 126. In certain instances, the sensor 152 can be a position sensor of a similar configuration to that of axial position sensor 150, a simple coil with a bias magnet (e.g., that detects position of the moving blades based on Faraday's Law), a biased Hall effect sensor, and/or another type of sensor. The sensor 152 can be a lower resolution sensor than the sensor 150.

A controller 156 is coupled to the sensors 150, 152, 154 to receive the signals output from each of the sensors. The controller 156 is also coupled to the magnetic actuators 136, 138 to send a control signal, either directly or through an amplifier, to the actuators to control the position of the rotor 130 and the turbomachine wheel 112. The controller 156 receives the signals from each of the sensors, and processes that information to generate control signals for the magnetic actuators 136, 138 and sends the resultant control signals to the magnetic actuators 136, 138 to control the position of the rotor 130 and the turbomachine wheel 112. The controller 156 can incorporate one or more control loops that respond to the signals from the sensors 150, 152, 154 in controlling the position of the rotor 130 and turbomachine wheel 112. In an example where sensor 152 is oriented to provide axial positional information, the controller 156 includes a control loop that responds to sensor 150 and sensor 152 (as an offset to control via sensor 150) or a control loop that responds to sensor 150 and a control loop that responds to sensor 152 (e.g., a slower control loop than that of sensor 150), and a control loop that responds to sensor 154.

Continuing this example, if the turbomachine wheel 112 and/or rotor 130 is displaced axially, the axial position sensor 150 and/or the sensor 152 will output signals to the controller 156 indicating the magnitude and direction of the axial displacement. The controller 156 then generates a control signal to the combination magnetic actuator 136 to cause the combination magnetic actuator 136 to act on the rotor 130 and move the rotor 130 axially to adjust for (e.g., counteract) the axial displacement. Similarly, if the rotor 130 moves radially, as a whole or misaligns, the radial position sensors 154 will output signals to the controller 156 indicating the magnitude of the radial displacement. The controller 156 then generates a control signal to one or both of the combination magnetic actuator 136 and radial magnetic actuator 138 to act on the rotor 130 and move the rotor 130 to adjust for (e.g., counteract) the radial displacement.

In examples having two or more separate turbomachine wheels 112, machine 100 can be provided with two or more sensors 152 and the controller 156 can control the position of the rotor 130 to maintain the position of the two or more turbomachine wheels 112 relative to one another. For example, the controller 156 can maintain the gap between one turbomachine wheel and an object to be greater by an adder or multiplier than a gap between a second turbomachine wheel and the same or a different object.

Controller 156 may include a processor 182 and a memory 184. The processor 182 can be implemented as solid state circuitry, integrated circuit, and/or digital circuitry (e.g., a microprocessor). Although illustrated as a single processor 182 in FIG. 1, two or more processors may be used. Generally, the processor 182 executes instructions and manipulates data to perform the operations of controller 156.

Memory 184 may include any memory or database module and may take the form of volatile or non-volatile memory including, without limitation, magnetic media, optical media, random access memory (RAM), read-only memory (ROM), removable media, or any other suitable local or remote memory component. Memory 184 may store various objects or data, including applications, for use by the controller 156.

Figure 2:
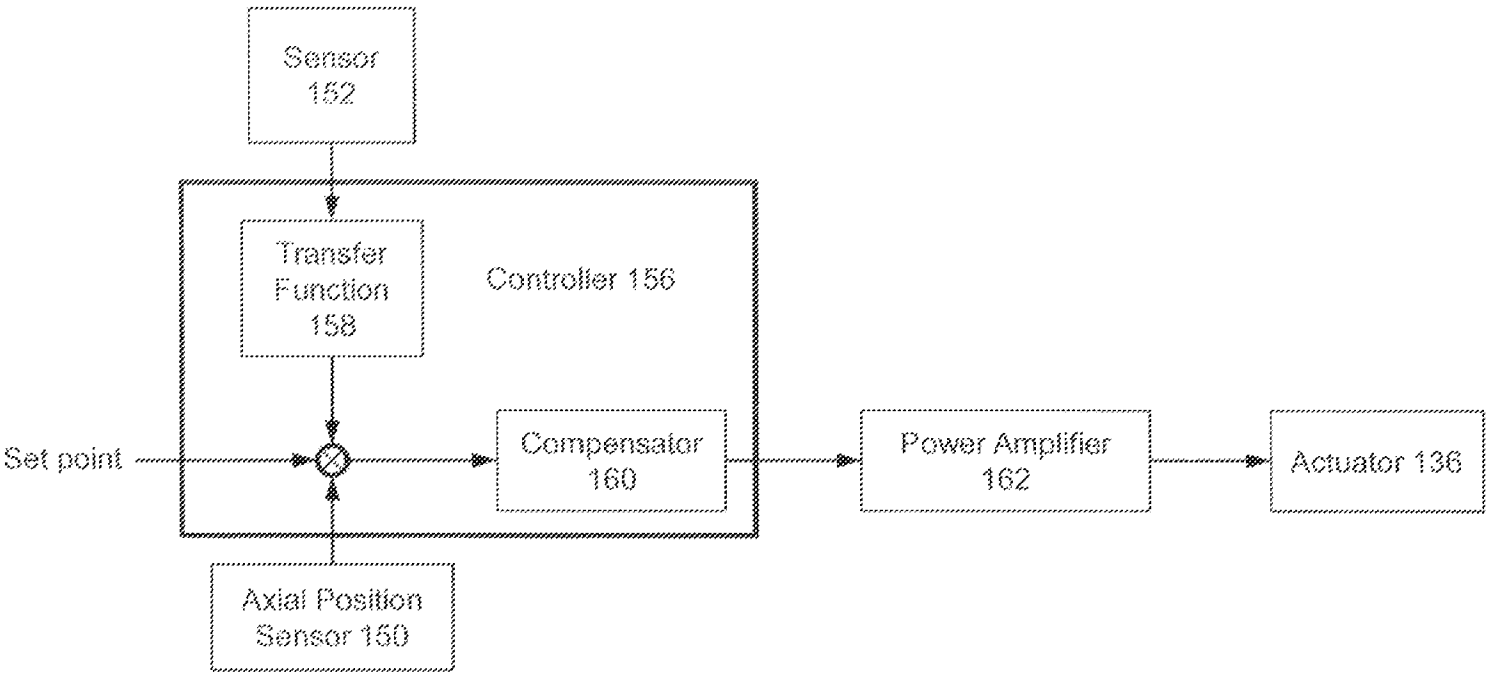
FIG. 2 is a schematic of an example axial control arrangement in accordance with the concepts described herein.

FIG. 2 is a schematic of an example axial control arrangement that can be used by controller 156. The same concepts can be applied to a radial control arrangement in instances where the sensor 152 is oriented to (alternatively or additionally) measure a radial displacement. In the example control arrangement of FIG. 2, controller 156 receives a set point input representative of a specified axial location or range of axial locations of the rotor 130 (shown in FIG. 1) for operation of the machine. The controller 156 receives outputs from the axial position sensor 150 and sensor 152. The controller 156 generates an error signal between the set point and the axial position of the rotor reported by the axial position sensor 150. The additional positional information reported by the sensor 152 is combined with that error signal as an offset (e.g., added/subtracted from the error signal). Based on the set point and outputs from the axial position sensor 150 and sensor 152, i.e., the error signal offset by the signal from sensor 152, the controller 156 determines a control signal that is communicated to the combination magnetic actuator 136 to cause the actuator 136 to act on the rotor 130 and control its axial position.

In the example of FIG. 2, the control signal is determined by a compensator algorithm 160 implemented in a processor, such as processor 182 (FIG. 1). In certain instances, the compensator algorithm 160 is a proportional, integral, differential (PID) control algorithm, but many other types of algorithms could be used. The control signal output by the compensator algorithm 160 can be amplified by an amplifier 162 when applied to the actuator.

In instances where the sensor 152 is sensing the blade tips as they pass, rather than a solid object, the signal from sensor 152 may be a periodic signal that peaks as each blade tip passes the sensor 152. In one example, the voltage output from the sensor 152 peaks as each blade tip passes and dips midway between blades. The resulting signal is a periodic voltage signal that has a frequency that is a function (e.g., in direct relation to) of the rotational speed of turbomachine wheel and an amplitude that is a function (e.g., in direct relation to) the distance of the blade tips from the sensor 152. Because the sensor 152 is fixed in relation to the shroud surface 126 (FIG. 1), the amplitude of the voltage is indicative of the distance between the blade tips and the shroud surface. In instances where the sensor 152 is flush with the shroud surface, the distance indicated by the sensor 152 is the distance of the blade tips from the shroud surface. The controller 156 can average the periodic signal to a monotonic signal, for example, a constant voltage signal. In one example, the controller 156 can use a filter circuit, such as a diode rectifier or another filter circuit, to produce a monotonic signal from the periodic signal.

The output of the sensor 152 can be modified by a transfer function 158 prior to being applied as an offset. For example, in certain instances, the frequency of the signal output from the sensor 152 is speed dependent. Variances in the frequency affect the magnitude of the monotonic signal, such that a certain monotonic value can represent different distances depending on the speed of the turbomachine wheel. The transfer function 158 can apply an adjustment to the output of the sensor 152 to account for this speed effect, and thus produce a monotonic signal that's magnitude has an absolute, non-speed dependent, correlation to distance. The calibration can be applied by a look-up table (e.g., a table of speed versus monotonic signal magnitude to yield non-speed dependent value), a formulaic calculation, and/or in another manner. In certain instances, the calibration is obtained by setting a desired minimum distance between the blade tips and sensor 152 (and/or shroud surface) at assembly of the machine, and spinning the turbomachine wheel up to operating speed while measuring the monotonic signal magnitude versus speed. Alternatively or additionally, the machine can be operated and the axial position of the rotor adjusted via the magnetic actuators to maintain a certain (e.g., best) machine and/or turbomachine wheel efficiencies as the turbomachine wheel is spun up to operating speed and the monotonic signal magnitude versus speed measured. In any instance, the resulting relationship between magnitude and speed can be incorporated into the transfer function 158.

Notably, although described as adjusting for the speed effect, the transfer function 158 can additionally or alternatively increase/decrease (e.g., scale or otherwise adjust) the magnitude of the monotonic signal, beyond that necessary to account for the speed effect, for example to weight the effect of the offset and/or for other reasons.

A number of embodiments have been described. Nevertheless, it will be understood that various modifications may be made. Accordingly, other embodiments are within the scope of the following claims.

What is claimed is:

1. A machine, comprising:

a rotor supported to rotate about a rotational axis;

an actuator arranged to act on the rotor and control a position of the rotor relative to the rotational axis;

a bladed turbomachine wheel coupled to the rotor and having blade tips that pass closely to an adjacent, non-rotating surface;

a sensor adjacent to the turbomachine wheel and arranged to sense the blade tips and output a position signal representative of the position of blade tips relative to the sensor; and a controller coupled to the sensor and the actuator and adapted to receive the position signal from the sensor and generate and send a control signal to the actuator to control the position of the rotor based on the position signal from the sensor.

2. The machine of claim 1, where the position signal from the sensor comprises a periodic signal, each period corresponding to passage of a blade tip by the sensor, and where the machine further comprises a circuit to average the periodic signal into a monotonic signal.

3. The machine of claim 2, where the controller is adapted to generate and send a signal to the actuator to control the position of the rotor based on:

a specified distance between the bladed turbomachine wheel and the adjacent, non-rotating surface, and a predetermined relationship between the monotonic signal, the speed of the rotor, and the position of the bladed turbomachine wheel.

4. The machine of claim 3, further comprising an axial position sensor arranged to measure the axial position of the rotor, and where the controller is coupled to the axial position sensor and adapted to receive a signal from the axial position sensor and generate and send a signal to the actuator to control the position of the rotor based on:

a specified distance between the bladed turbomachine wheel and the adjacent, non-rotating surface;

the signal from the axial position sensor; and a predetermined correlation between the monotonic signal, the speed of the rotor and the position of the bladed turbomachine wheel.

5. The machine of claim 4, where the specified distance is determined based on a specified efficiency of the turbomachine wheel.

6. The machine of claim 1, further comprising an axial position sensor arranged to measure the axial position of the rotor, and where the controller is further coupled to the axial position sensor and adapted to receive a signal from the axial position sensor and generate and send a signal to the actuator to control the axial position of the rotor based on the signal from the axial position sensor and the signal from the sensor adjacent to the turbomachine wheel.

7. The machine of claim 6, where the controller is adapted to generate, based on the signal from the sensor adjacent to the turbomachine wheel, an offset to the axial position sensor signal.

8. The machine of claim 1, where the control signal generated by the controller compensates for thermal expansion of the bladed turbomachine wheel.

9. The machine of claim 1, where the non-rotating surface is a shroud surface to the turbomachine wheel.

10. The machine of claim 1, where the bladed turbomachine wheel is a centrifugal impeller, the adjacent, non-rotating surface is a shroud surface, and the sensor is arranged to sense the blade tips oriented toward the shroud surface.

11. The machine of claim 1, where the bladed turbomachine wheel comprises a compressor, a pump, or a turbine.

12. The machine of claim 1, where the sensor comprises a coil with a bias magnet.

13. The machine of claim 1, where the actuator is a magnetic actuator associated with a magnetic bearing, and the machine of claim 1 further comprising a radial magnetic bearing arranged to support the rotor to rotate about the rotational axis.

14. A method, comprising:

sensing passage of blade tips of a rotating bladed turbomachine wheel by a sensor and outputting a signal representative of the position of the blade tips relative to the sensor; and generating an actuator control signal to control a position of the bladed turbomachine wheel based on the signal.

15. The method of claim 14, where the signal representative of the position of the blade tips is periodic and the method comprises transforming the periodic to a monotonic signal.

16. The method of claim 15, where the method further comprises adjusting the monotonic signal to account for the rotational speed of the bladed wheel.

17. The method of claim 14, further comprising sensing the axial position of a rotor carrying the turbomachine wheel and outputting a second signal; and wherein generating an actuator control signal to control a position of the bladed turbomachine wheel comprises generating an actuator control signal to control a position of the bladed turbomachine wheel based on the first mentioned signal and the second signal.

18. A turbomachine, comprising:

a magnetic bearing system comprising magnetic actuators that support a rotor to rotate about a rotational axis;

a bladed turbomachine wheel coupled to the rotor and having blade tips that pass closely to an adjacent shroud surface;

an axial position sensor arranged to sense the rotor and output an axial position signal representative of the axial position of the rotor;

a sensor affixed at the shroud surface and arranged to sense the blade tips and output a position signal representative of the axial position of blade tips relative to the shroud surface; and a controller coupled to the axial position sensor, the sensor affixed at the shroud surface, and the magnetic actuators, the controller is adapted to control the axial position of the rotor based on the output from the axial position sensor and the sensor affixed at the shroud surface.

19. The turbomachine of claim 18, where the sensor affixed at the shroud surface outputs a periodic signal and the controller is adapted to transform the periodic signal to a monotonic signal; and where the controller is adapted to control the axial position of the rotor based on the output from the axial position sensor, the monotonic signal derived from the output of the sensor affixed at the shroud surface and the rotational speed of the rotor.

20. The turbomachine of claim 18, where the bladed turbomachine wheel comprises a compressor, a pump, or a turbine.

* * * * *